US005222513A

United States Patent [19]

Hilliard

[11] Patent Number: 5,222,513

[45] Date of Patent: Jun. 29, 1993

[54] TENT SYSTEM

[76] Inventor: Sarah M. Hilliard, 6720 N. 44th Ave., Apt. 154, Phoenix, Ariz. 85301

[21] Appl. No.: 986,879

[22] Filed: Dec. 4, 1992

Related U.S. Application Data

[63] Continuation of Ser. No. 488,143, Mar. 5, 1990, abandoned.

[51] Int. Cl.[5] ..... E04H 15/18

[52] U.S. Cl. ..... 135/97; 135/117; 135/908

[58] Field of Search ..... 135/94, 97, 900, 908, 135/115, 117, 119, 101; 52/79.7

[56] References Cited

U.S. PATENT DOCUMENTS

| | | | |
|---|---|---|---|
| 1,420,671 | 6/1922 | Schuette | 135/DIG. 9 X |
| 2,508,679 | 5/1950 | McClellan et al. | 135/1 |
| 3,017,893 | 1/1962 | Greenbie | 135/DIG. 8 X |
| 3,222,067 | 12/1965 | Litwhiler et al. | 273/26 |
| 3,802,133 | 4/1974 | Gregory | 52/86 |
| 3,925,942 | 12/1975 | Hemmelsbach | 52/86 |
| 3,965,915 | 6/1976 | Kirkham | 135/97 |
| 4,011,880 | 3/1977 | Shoults | 135/100 |
| 4,063,566 | 12/1977 | Millerioux | 135/97 |
| 4,886,084 | 12/1989 | Lawrence et al. | 135/DIG. 8 X |

FOREIGN PATENT DOCUMENTS

| | | | |
|---|---|---|---|
| 2732674 | 2/1979 | Fed. Rep. of Germany | 135/106 |
| 1367 | of 1871 | United Kingdom | 135/97 |
| 468045 | 6/1937 | United Kingdom | 135/106 |

OTHER PUBLICATIONS

*Aerolande*, French publication, Apr. 1974, pp. 227-232.

*Primary Examiner*—Richard E. Chilcot, Jr.
*Assistant Examiner*—Lan M. Mai
*Attorney, Agent, or Firm*—Richard G. Harrer

[57] ABSTRACT

A tent system having at least three tents, with each tent being free standing. Each of the tents is arranged about the perimeter of a common area, and, in a most preferred embodiment, each tent is arranged in a substantially uniform manner about the perimeter of the common area. Each of the tents has a front and rear wall and side walls with the front wall provided with a horizontally disposed eave line. Each of the tents is provided with an awning like structure which is secured to the front wall of each tent along the horizontally disposed eave line and which extends outwardly over the common area to form a section of a roof assembly, with the roof assembly covering a substantial portion of the common area. Each roof section is releasably secured to its adjacent roof section and this may be accomplished by means of a zipper, "Velcro" fastening tape or, snap fasteners and the like. In order to strengthen the roof assembly it is preferred that a sleeve be provided in one of the mating edges of a roof section, the sleeve extending substantially the length of the edge for receiving a reinforcing member such as a pole. The tent system also includes an enclosure which runs between adjacent tents and surrounds the common area to limit access thereto, with at least one of the enclosures being hingedly secured to a corner of one tent and releasably secured to the opposite corner of an adjacent tent to allow for the exit and entry into the common area from the area outside.

6 Claims, 3 Drawing Sheets

TENT SYSTEM

This is a continuation of copending application Ser. No. 07/488,143, filed Mar. 5, 1990 now abandoned.

This invention relates to a tent system in which multiple tents or a community of tents are joined together in such a manner that an enclosed common area is provided that is substantially protected from the elements and roving animals.

BACKGROUND OF THE INVENTION

No one really knows where or when the idea of the tent came from, although it has been known that animal skins stretched over wooden frames of varying shapes have been used as shelters for literally thousands of years. A very early and probably first mention of tents occurs in the Old Testament of the Bible. Noah "was within his tent" when warned about a storm and Lot "had tents" which apparently was a sign of some wealth at the time. The basic framework of the Roman soldiers' tent was a single pole driven into the ground. Fabric was draped over it and staked to the ground forming a pyramidal shape. Apparently, this primitive tent had been used for centuries before the Romans adopted it and even some versions are still used today. After the Civil War, the settling of the western portion of the United States was undoubtedly aided by the tent. It is known that pioneers lived in tents for long periods of time as they built their farm buildings. The boom towns that developed throughout America whenever a valuable metal such as gold or when oil was discovered were composed mainly of tents at first. Then, as the trains connected these towns and as lumber became cheaper and more available, permanent housing was built.

Today, tents are still very popular; being used for a wide variety of purposes. Certainly, a large market for tents is for recreational use and such tents can range from very lightweight models sheltering one person to what are called fixed-camp tents which are much larger and are preferred by those to whom extra space is more important than light weight and ease of carrying. Tents also have important non-recreational uses and often serve as temporary shelters when disasters occur and, more recently have been used in a number of communities as temporary housing for homeless people. Expeditions that are sent out into wilderness areas also find the need for tents as shelters for the people involved in the project, and it is not uncommon to find a number of tents erected, some of which serve to house the people, others may serve for food preparation, for bathing and toilet use and the like. In all such situations where a number of tents are involved in sheltering people, the individual tent structures are separate from other of the tent structures and although there is a so-called community of tents, there is usually no provision made to provide for protection from the elements such as rain and snow when the occupants are outside of the individual tents, nor is provision made to secure a common area from roving animals and the like.

Consequently, there is a need for a shelter arrangement which includes multiple tents or a community of tents which are arranged and joined together in such a manner that each tent in effect shares a common area immediately adjacent the tent with other of the tents and which common area is substantially sheltered from the elements and from roving animals as well.

With the foregoing in mind it is therefore an object of this invention to provide a tent system in which multiple tents are joined together in such a manner so as to provide an enclosed common area which is substantially protected from the elements and from roving animals.

It is a further object of this invention to provide a tent system in which the common area is immediately adjacent to an entry or exit from each of the tents included in the system.

It is a still further object of this invention to provide such a system in which the additional cost and effort to gain the advantages thereof is rather minimal over and above the cost of the individual tents themselves, which is portable and that it is relatively easy to erect and dismantle when necessary and transport the system to another site.

These and other objects of this invention will be more apparent as this specification proceeds.

SUMMARY OF THE INVENTION

This invention involves a tent system wherein multiple tents or a community of tents are arranged about the perimeter of a central or common area with the common area being substantially protected from the elements and roving animals. That is, the occupants of the tents exit from a tent directly into the protected common area, the common area also being protected from roving animals and the like. Provision in the tent system is made for exit and entry from the common area to the outside. The system includes multiple tents, preferably of the fixed camp type which tents are also sometimes referred to as umbrella, cabin or wall tents. Such fixed camp tents are at their best in a semi-permanent set up as is contemplated in this system. Characteristically, such tents are large enough or spacious enough to permit the use of cots, tables, and the like. Preferably the side of each tent facing the common area is provided with a door to enter and exit the common area and most preferably the tents are substantially uniform in size and arranged in a substantially uniform manner about the perimeter of the common area. Each of the tents is provided with an awning like structure which is preferably secured to or near the front eave line of the tent. The awnings of each tent, which extend outwardly to the common area and preferably upwardly from the front eave line of each tent, are joined together in a releasable fashion at their respective side edges to form a roof like structure over substantially all of the common area. Thus, each awning in effect becomes a section of a roof over the common area. In a preferred embodiment, the awnings or roof sections are joined together in such a manner as to provide an opening in the roof to provide light and ventilation. The tent system also includes enclosure means connecting each adjacent tent to further protect the common area from the elements and also from roving animals. In a preferred embodiment, such enclosure means are formed from a sheet of material resembling a tarpaulin and made of a fabric of the type commonly used in tents. One edge of such fabric sheet is secured to a tent, preferably at a corner edge thereof and the fabric sheet then extends to the corner edge of an adjacent tent where it is releasably secured by means of a zipper, snap fastener and the like. Thus this enclosure means which is connected between adjacent tents serves to effectively prevent roving animals from entering the common area and also serves as a wind break to further protect the common area.

DETAILED DESCRIPTION OF THE INVENTION

Figure 1:
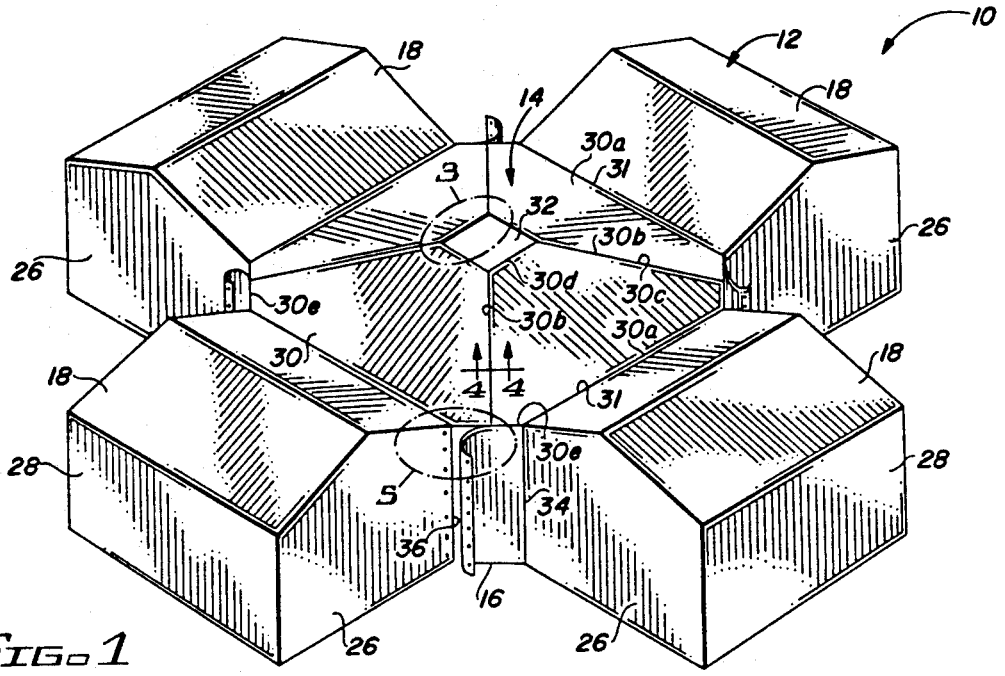
FIG. 1 is a perspective view of a tent system employing four tents.
Figure 2:
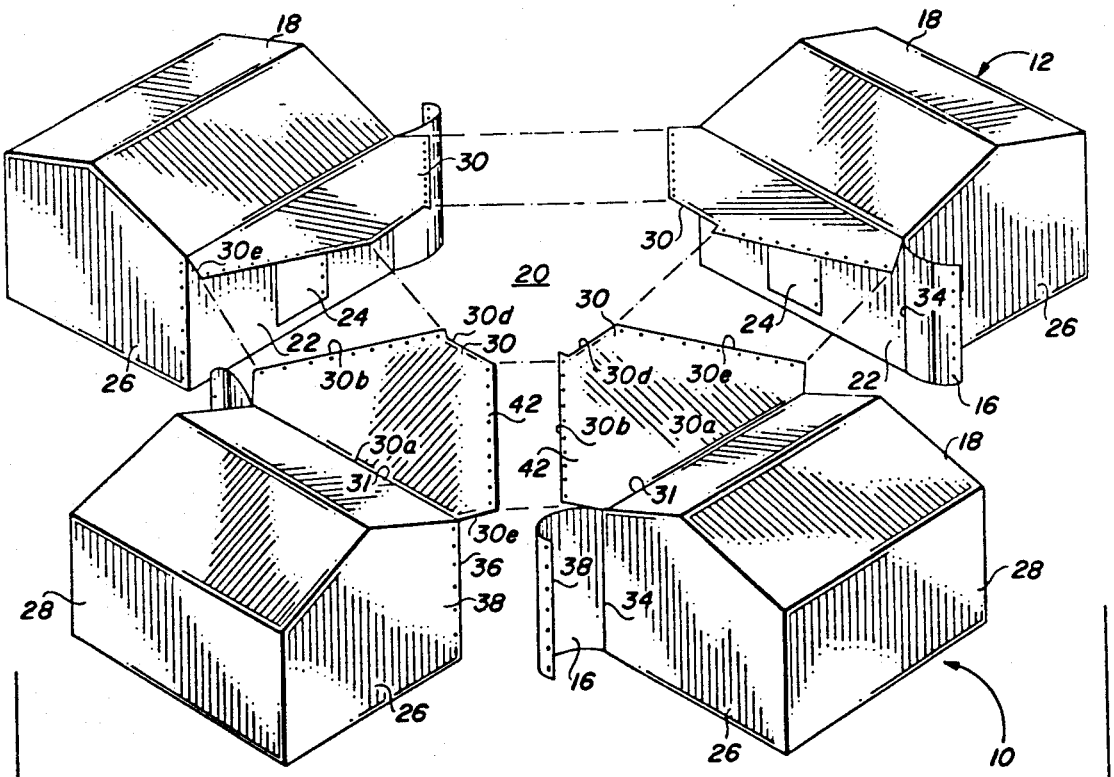
FIG. 2 is a perspective view of the tent system of FIG. 1 wherein each tent section is separated somewhat from the tent system to enhance the details of the system.

FIGS. 1 and 2 are perspective views of one preferred embodiment of the tent system which is shown generally at 10 and which comprises four individual tents 12 arranged about a common area 20 with a roof assembly designated 14 and ground enclosure means comprising a fabric flap-like structure 16 connecting adjacent tents. As shown, each tent is of the cabin or wall type and includes front wall 22 facing the common area, side walls 26, rear wall 28 and a hip style roof 18. Each of the tents is provided with an entry 24 to the tent. As shown, each of tents 12 is arranged about the perimeter of the common area 20 and in a substantially uniform pattern. That is, the distance between opposing tents is substantially equal; also the distance between tents is substantially the same. Although not shown, each tent is provided with an appropriate frame, be it an inside or outside frame and guying and staking where required, all as is well understood in the tent art.

A roof assembly designated generally as 14 is provided which assembly, except for opening 32, substantially covers the common area 20. Roof assembly 14 is made up of four generally triangular shaped sections 30, with edge 30*a* of each section being secured to the front eave line 31 of each tent. Each roof section may be made of a fabric such as is customarily employed in the manufacture of tents and can also include flexible waterproof sheet plastics since breathability is not a factor. Preferably, the fabric is both water resistant and treated to have fire retardant qualities. In securing roof section 30 to the eave line 31, they may be sewn to the tent or secured by means of snap fasteners, zippers, Velcro® fastening tape and the like.

Figure 3:
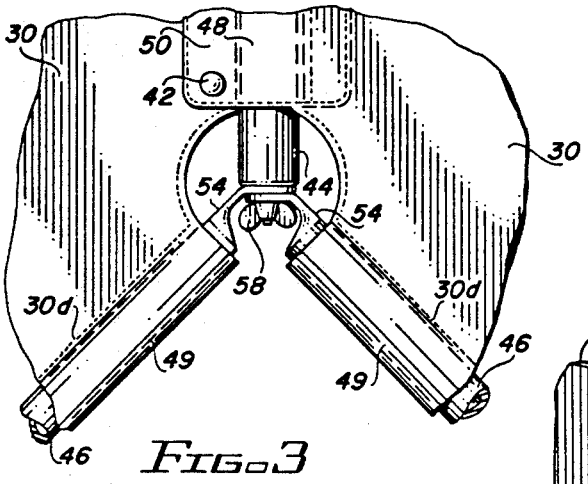
FIG. 3 is a detailed view of the area designated "3" of FIG. 1.
Figure 4:
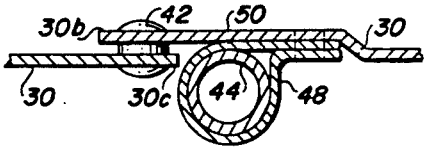
FIG. 4 is a sectional view taken on the line 4—4 of FIG. 1.
Figure 7:
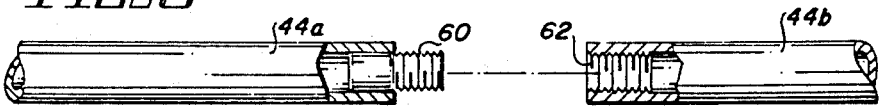
FIG. 7 is a part perspective view of a support member.

As best shown in FIGS. 2–4, each roof section is releasably secured to its adjacent roof section. That is, edge 30*c* of one section is secured to edge 30*b* of an adjacent section and this may be accomplished by means of a zipper, Velcro fastening tape, or, as shown in FIG. 4, by means of snap fasteners 42. Moreover, to strengthen the roof assembly, and as shown best in FIGS. 3 and 4, a sleeve 48 is provided in one of the mating edges 30*b* or 30*c* of roof section 30, which sleeve extends the length of edge 30*b* or 30*c* for receiving a reinforcing member or pole 44. As shown in FIG. 7, to provide for easier storage, pole 44 may be formed of multiple segments, such as segments 44*a* and 44*b* with one segment having threaded end 60 and the other having threaded socket 62. Thus, joining of the segments to form a single pole is easily accomplished by merely screwing the two sections together.

Figure 6:
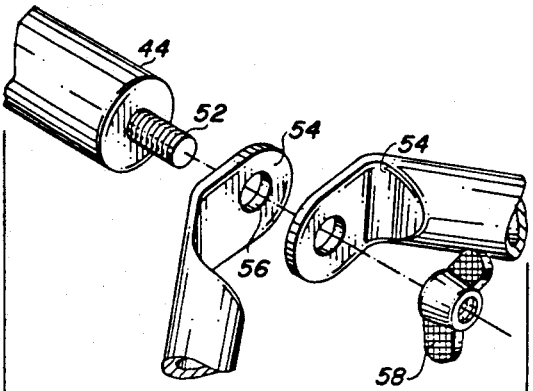
FIG. 6 is a perspective view in detail showing the joining of the support members shown in FIG. 3.

As shown best in FIG. 3, the roof assembly 14 may be further reinforced or strengthened at edges 30*d* which surround opening 32 of each roof section 30 by again providing a sleeve 49 along each of the edges 30*d* and placing a reinforcing pole 46 in each of the four sleeves 49. Again as shown in FIG. 3 and in greater detail in FIG. 6, reinforcing poles 44 and 46 are joined together where they intersect to form a frame by means of suitable hardware. That is, end of pole 44 is provided with machine screw 52 and each end of pole 46 is provided with connector 54 having opening 56. Machine screw 52 is inserted into opening 56 of connectors 54 and the assembly is secured by means of wing nut 58. Although not shown, it is appropriate to incorporate additional support for the roof assembly and this may be accomplished by fitting support posts or poles between any of the reinforcing poles 44 or 46 and the ground of the common area. Preferably such support posts engage the reinforcing poles at or near the center of the roof assembly.

Figure 5:
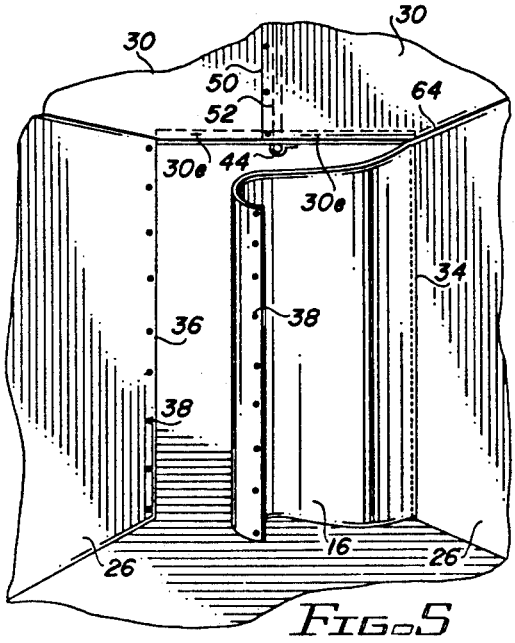
FIG. 5 is a detailed view of the area designated "5" of FIG. 1.

As shown in FIGS. 1, 2 and 5, the tent assembly also includes enclosure means 16 between each adjacent tent. Such means serve to additionally protect the common area from the elements and also serves an important function in securing the common area from roving animals. As best shown in FIG. 5, such enclosure means can be a flap like structure which extends between corner 34 of a tent to corner 36 of an adjacent tent, and in the embodiment shown is made of a flexible fabric such as is customarily used in tent construction. As with the roof, it is preferable that the fabric be both water resistant and treated to have fire retardant qualities. As shown, a flap 16 may be hingedly secured to corner 34 of tent 26 by means of appropriate stitching, and is releasably secured by means of snap fasteners 38 to opposite corner 36 of adjacent tent 26. Flap 16 is appropriately sized to substantially enclose the area between adjacent tents. Flap 16 also serves as an entry and/or exit to and from the common area. It may also be desirable to reinforce edges 30*e* of each of roof sections 30 and, as shown in FIG. 5, this again may be accomplished by providing a sleeve 64 in each of edges 30*e* and then inserting a suitable reinforcing pole or rod in each sleeve 64.

Figure 8:
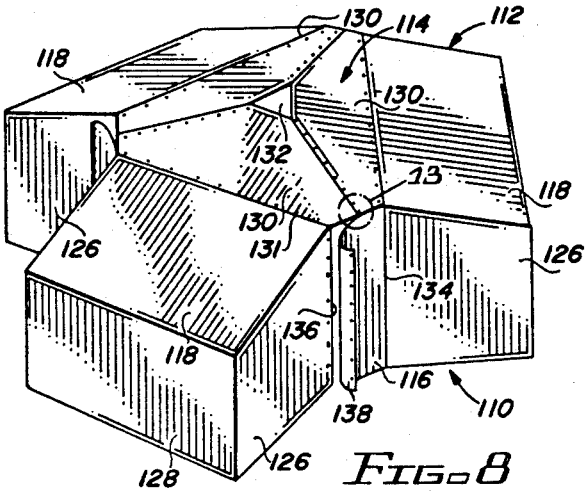
FIG. 8 is a perspective view of a tent system employing three tents.
Figure 9:
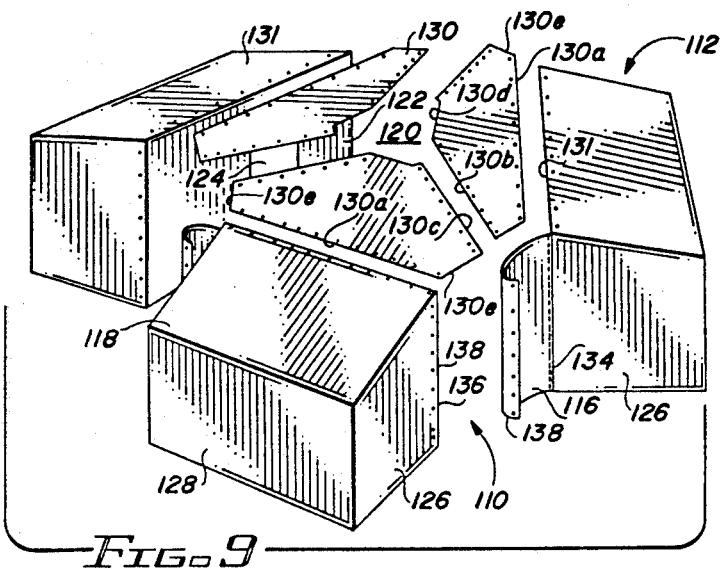
FIG. 9 is a perspective view of the tent system of FIG. 10 with each tent section separated somewhat from the tent system to show details of the system.

FIGS. 8 and 9 are perspective views of another preferred embodiment of the tent system shown generally at 110 which comprises three individual tents 112 arranged about a common area 120 with a roof assembly designated 114 and ground enclosure means 116 connecting adjacent tents. The construction of tent system 110 is basically the same as that shown for the previously described tent system 10, the exception being that three tents are employed rather than four. As shown, each tent is again of the cabin or wall tent type and includes front wall 122 facing the common area, side walls 126, rear wall 128 and a lean to style roof 118. As with the tent system 10 each of the tents is preferably provided with an entry 124 and, as shown, each tent is arranged about the perimeter of a common area 120 and in a substantially uniform pattern.

The roof assembly designated generally as 114, except for generally triangular shaped opening 132, substantially covers the common area. Roof assembly 114 is made up of three generally triangular shaped sections 130, with an edge 130*a* of each section being secured to the front eave line 131 of each tent. Each roof section is preferably made of a fabric such as employed in the manufacture of tents and can also include flexible waterproof plastics since breathability is not a factor. In securing each roof section 130 to the eave line 131 of each tent, the section may be sewn to the tent or secured by means of snap fasteners, zippers or the like.

Figure 11:
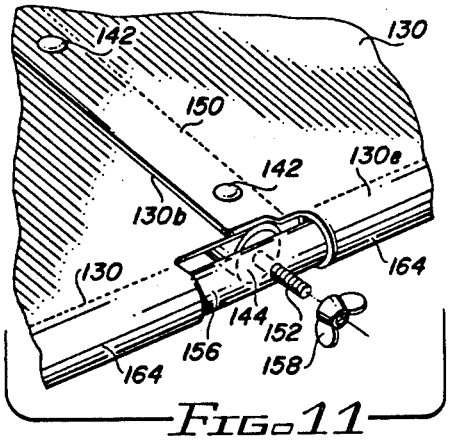
FIG. 11 is a detailed view of the area designated "11" of FIG. 10.

Again as with tent system 10, each roof section is releasably secured to an adjacent section. That is, edge 130*c* of one section is secured to edge 130*b* of an adjacent section and this may be accomplished by means of a zipper or, as shown in FIG. 11, by means of snap fasteners 142. In a manner similar to that previously discussed with respect to tent system 10, a sleeve is provided in one of the mating edges 130*b* or 130*c* which sleeve runs the length of edge 130*b* or 130*c* for receiving a reinforcing member or pole. Additionally, and in the same manner as shown with respect to tent assembly 10, roof assembly 114 is further reinforced or strengthened at edges 130*d* of each roof section 130 by again providing for sleeves at each of the edges 130*d* and pacing a pole or other reinforcing member in each of the three sleeves. The reinforcing poles are then joined again in a manner similar to that shown in FIGS. 3 and 6 with respect to tent system 10. As shown in better detail in FIG. 11, edge 130*b* of roof section 130 is provided with flap 150 and sleeve 148 positioned beneath the flap. Positioned within sleeve 148 is reinforcing pole 144. One end of pole 144 is provided with machine screw 152. Edge 130*e* of each roof section is reinforced by means of pole 156 which is inserted into each sleeve 164. Screw 152 is together by means of wing nut 158.

Figure 13:
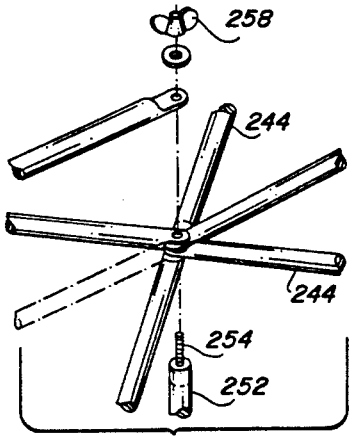
FIG. 13 is a perspective view of a roof support system which may be employed in the various tent systems.
Figure 10:
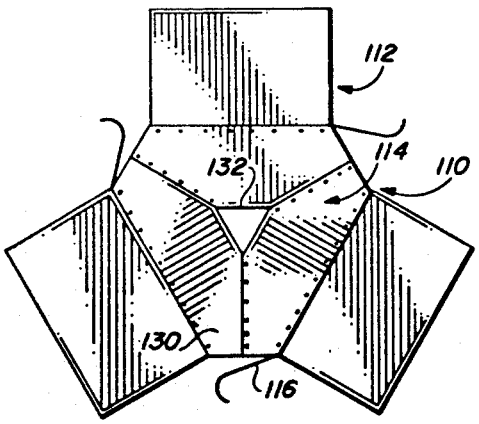
FIG. 10 is a plan view of the tent system of FIG. 8.
Figure 12:
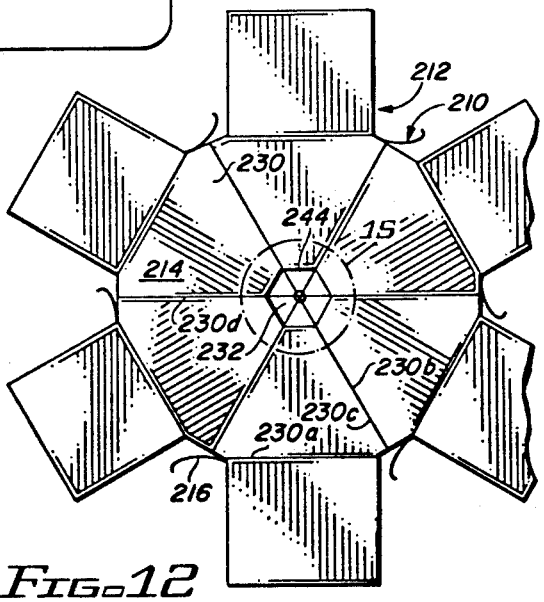
FIG. 12 is a plan view of a tent system employing six tent sections.

FIG. 12 is a plan view of a still further embodiment of the tent system employing six individual tents 212 and the entire system being designated generally as 210. As with previous embodiments, the tents 212 are arranged about a common area and provided with a roof assembly 214 having an opening 232 for light and ventilation. The assembly is also provided with enclosure means 216 as with previously described embodiments. This particular embodiment employs a modified means for supporting the roof assembly which is shown in some detail in FIG. 13. As with tent systems 10 and 110, each roof section 230 is releasably secured to an adjacent section, that is, edge 230*c* of one section is secured to edge 230*b* of an adjacent section and in a manner as previously described. Although not shown, a sleeve is also provided in one of the mating edges 230*b* or 230*c* which sleeve runs the length of such edges for receiving a stiffening member or pole 244 (see FIG. 13). In this particular embodiment, poles 244 do not terminate at edge 230*d* but extend and intersect as shown in FIG. 13. At the point where the reinforcing poles 244 intersect, they are secured together by various means. This construction eliminates the need for additional reinforcing along edges 240*d*. In the various embodiments of the tent system it may be advisable or necessary to provide for additional support for the roof structure over and above that previously described. Thus, for example, with respect to the system shown in FIGS. 12 and 13 a support post or pole 252 extends from the ground to the intersection of poles 244 and the entire assembly is secured together by means of threaded end 254 of pole 252 and wing nut 258.

What is claimed is:

1. A tent system comprising at least three tents arranged about the perimeter of an area common to each of said tents, each of said tents having front and rear walls and side walls with the front wall thereof provided with an entry to said tent, said front wall being further provided with a horizontally disposed eave line, an awning like member one edge of which is secured along said eave line and extending outwardly over said common area to form a roof section of a roof assembly which assembly substantially covers said common area, with each of said roof sections being releasably secured to an adjacent roof section at their mating edges to form said roof assembly, means along said mating edges to receive a roof assembly reinforcing member, and enclosure means connecting adjacent tents and surrounding said common area to limit access to said common area with at least one of said enclosure means being hingedly secured to a corner of one tent and releasably secured to the opposite corner of an adjacent tent.

2. The system of claim 1 wherein said one edge of said awning like member is releasably secured to said eave line.

3. The system of claim 2 wherein said means to receive a roof assembly reinforcing member is a sleeve mounted to one of the mating edges of adjacent roof sections.

4. The system of claim 3 wherein said roof assembly includes a central opening providing light and ventilation of said common area.

5. The system of claim 4 wherein said tents are arranged in a substantially uniform manner about the perimeter of said common area and wherein each of said roof sections extend upwardly from said eave line.

6. The system of claim 5 wherein each edge of said roof section which surround said central opening is provided with a reinforcing member.

* * * * *